US006780246B1

(12) United States Patent
Appelbaum et al.

(10) Patent No.: US 6,780,246 B1
(45) Date of Patent: Aug. 24, 2004

(54) ADHESIVE APPLICATION APPARATUS FOR SMALL PACKAGES

(76) Inventors: Paul Appelbaum, 16371 Wimbledon La., Huntington Beach, CA (US) 92649; Gary Eddington, Jr., 6352 Royal Oak, Huntington Beach, CA (US) 92647; James D. Howard, 7192 Bestel Ave., Westminster, CA (US) 92683

( * ) Notice: Subject to any disclaimer, the term of this patent is extended or adjusted under 35 U.S.C. 154(b) by 0 days.

(21) Appl. No.: 10/378,499

(22) Filed: Mar. 4, 2003

(51) Int. Cl.[7] ..... B05C 1/06

(52) U.S. Cl. ..... 118/264; 118/268; 156/578

(58) Field of Search ..... 118/264, 268; 427/429; 401/198, 199, 207; 15/257.05; 222/187; 239/44; 156/578, 441.5

(56) References Cited

U.S. PATENT DOCUMENTS 4,913,350 A * 4/1990 Purzycki ..... 239/44

* cited by examiner

*Primary Examiner*—Laura Edwards

(57) ABSTRACT

Apparatus for applying adhesive to outer edge portions of a generally rectangular clear plastic package piece has a lower portion that is a reservoir for liquid adhesive and an upper portion comprising a cover plate for the reservoir and having a flat rectangular top surface with a slot extending along each of the opposing sides of the top perimeter. Additionally, there a pair of longitudinally extending slots along the middle of the top surface and lateral slots extend through other portions of the cover plate. For each slot there is a removably mounted wick assembly, each assembly including a sheet of felt-like wick material that is looped around a rigid support bar with a lower part of the wick material extending downwardly into the reservoir. An upper portion of the wick extends a certain distance above the surface of the cover plate.

5 Claims, 3 Drawing Sheets

ADHESIVE APPLICATION APPARATUS FOR SMALL PACKAGES

BACKGROUND OF THE INVENTION

1. Field of the Invention

The present invention relates to apparatus for allowing an operator to apply liquid adhesive to the side edges of a component piece of a plastic package, and more particularly to an apparatus for application to all or selected edges of a generally rectangular clear plastic piece.

2. Description of the Prior Art

Today it is quite common to find small articles for sale packaged in clear plastic "shells" or packages that secure their contents while allowing them to be visually displayed for the benefit of the shopper. Such packages can have two separate components, a lid and a bottom piece, or can be a "clamshell" type package where the two components, lid and bottom, are attached along one edge by an integral "living hinge" of material. Another popular package has a tubular sleeve that is sealed with rectangular end caps. See FIGS. 1–3 for illustrations of these package examples.

During the packaging process it is often necessary to apply adhesive to four sides of a piece. In other cases, such as with clamshell type packages, adhesive is applied to at least the edge opposite the living hinge, or to all three available edges for increased security.

The conventional way of applying adhesive is directly from the tip of a hand-held bottle dispenser, or by brush, roller or other manual applicator. Unfortunately such techniques suffer from inconsistency and waste; i.e. the application can often be insufficient or excessive, as well as uneven. It is also noted that the quality of application will vary from one operator to the other. This can result in the scrapping of packages, or finished packages lacking the desired clean even finished look.

The problem of wasteful and inefficient glue application is particularly important where relatively expensive adhesives are used such as in UV-activated liquid adhesive systems.

SUMMARY OF THE INVENTION

In view of the foregoing it is a general object of the present invention to provide an improved apparatus and method for applying liquid adhesive to edges of a plastic package component.

A more specific object is to provide an apparatus that will allow an operator to apply a desired thin, even deposit of adhesive in a quick reliable and consistent manner.

A further object is to provide an efficient method and apparatus that will minimize packaging costs.

Yet another object is to provide for a sealed finished package that has a clean, clear even look.

A further object is to provide apparatus that can be configured for application of adhesive to one, two, three or all four sides of a rectangular package component, as desired.

These and other objects and advantages are provided by the present invention of apparatus for applying adhesive to the outer edges of a generally rectangular package component, the invention having an upper portion and a lower portion. The lower portion comprises a reservoir for holding liquid adhesive and the upper portion features a rectangular top plate with a smooth flat top surface.

There is a least one pair of opposing transverse slots and longitudinal slots in the top plate, arranged in a rectangular configuration.

The invention further includes adhesive wick assemblies that can be removably installed in the slots, each wick assembly having an elongate upper portion which projects a predetermined distance above the plate top surface when said assembly is installed in the slot, and a lower portion that extends downwardly into the confines of the reservoir.

When a wick assembly is mounted in all four slots, the upper parts of the assemblies provide a rectangular border around a rectangular space on the top plate.

In operation, liquid adhesive from the reservoir will be drawn up to wet the exposed upper parts of the wick assemblies, and a package piece that is smaller than the opening is placed in the opening with the piece bottom slidably supported by the top plate. The operator can then use a simple "circular" motion to move the sides of the piece into successive engagement with each of the wetted wicks.

In one embodiment of the invention the wick assembly comprises an elongate support bar and a felt-like wick member that is looped around the support bar.

Another embodiment has slots along the perimeter of the top plate, and additional transverse and longitudinal slots are provided in the major surface of the plate. Thus the invention allows wick assemblies to be arranged to accommodate a variety of package sizes and to apply adhesive to selected edges of the piece.

DETAILED DESCRIPTION OF THE INVENTION

Figure 1:
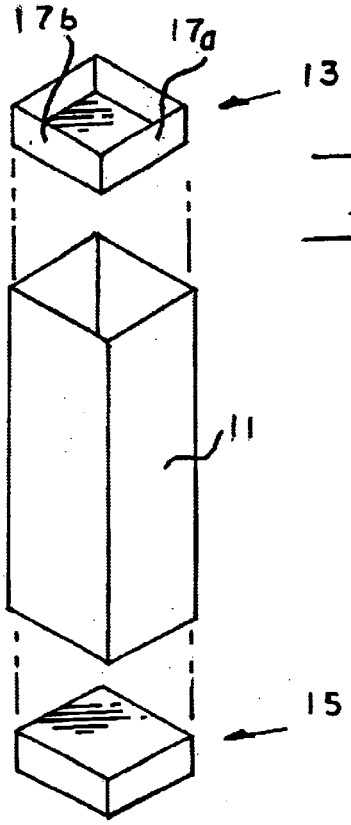
FIG. 1 is a perspective view of one type of package that can be prepared using apparatus according to the present invention.
Figure 3:
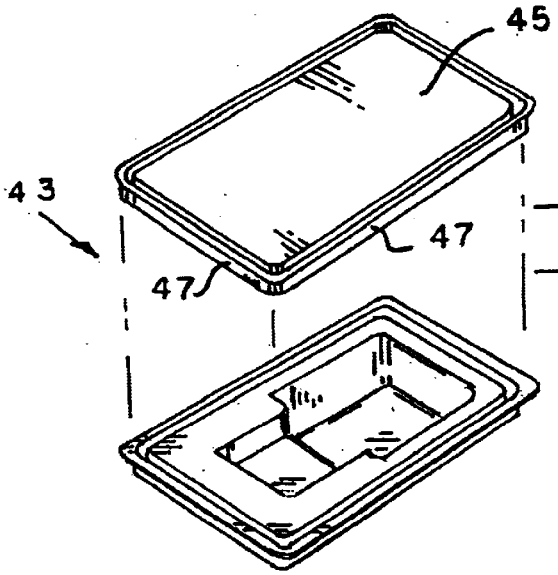
FIG. 3 is a perspective view of a two-piece type of package.
Figure 2:
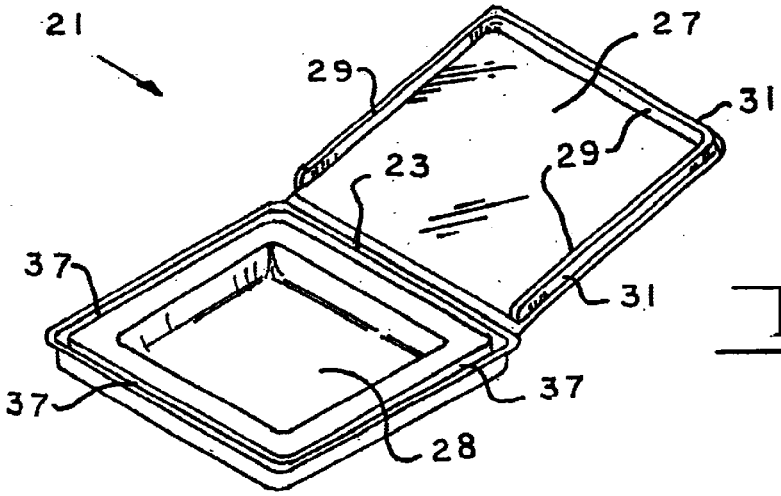
FIG. 2 is perspective view of a clamshell type package.

Referring now to the drawings, FIGS. 1, 2 and 3 illustrate some of the package designs to which adhesive can be applied in a most advantageous fashion using apparatus according to the present invention.

FIG. 1 is a popular clear plastic package for small articles that has a tubular body 11 and end cap 13 that is received within the upper part of body 11 and cap 15 that fits the lower end of body 11. During package assembly the four sides of cap 13 including surfaces 17*a* and 17*b* must be coated with adhesive prior to placement in body 11 and subsequent curing, such as irradiation by UV light in the case of UV activated adhesive. The typical clamshell package 21 shown in FIG. 2 includes a living hinge at 23, and a lid 27 that has male edges 29 that engage grooves 37 in piece 28. The present invention is adapted to apply adhesive to the outer surfaces 31 of the three male ridges of the cover 27. The package 43 of FIG. 3 is another clear plastic package having a lid 45 with four male ridges 47 to which adhesive is to be applied.

Figure 4:
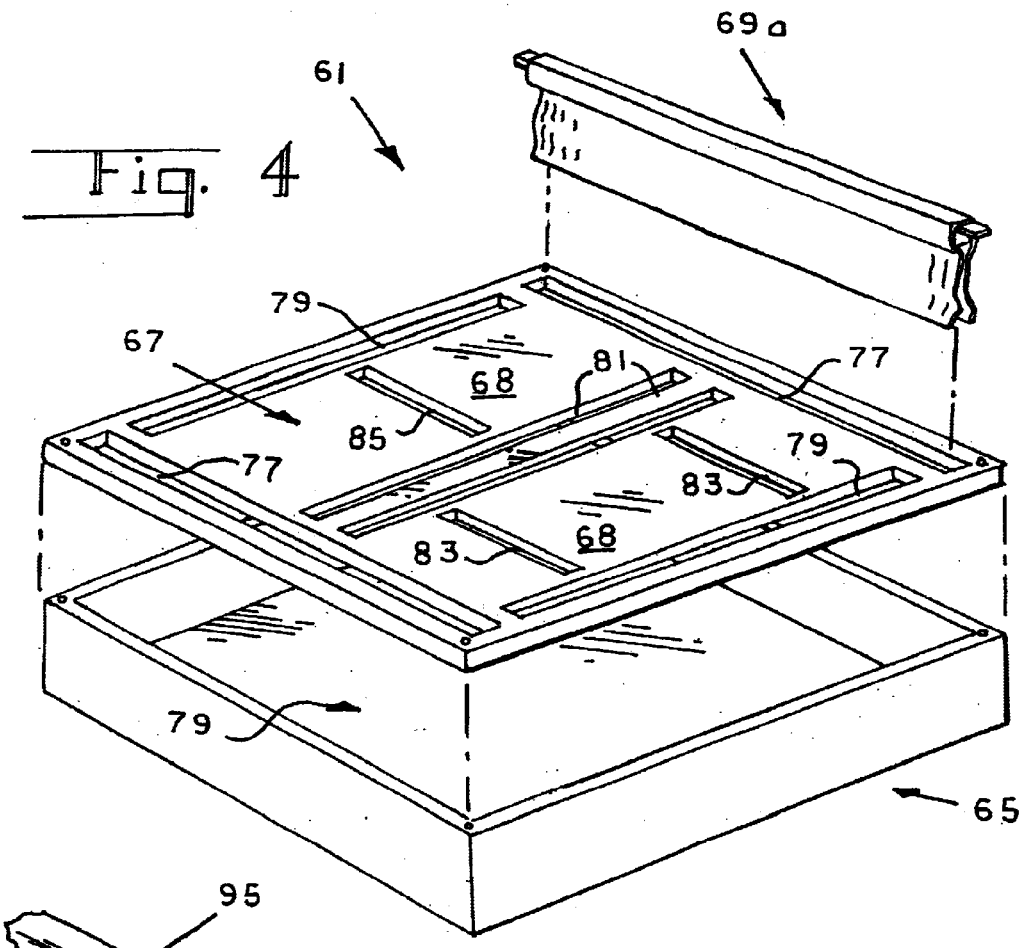
FIG. 4 is an exploded perspective view of a preferred embodiment of an adhesive application apparatus according to the present invention.

FIG. 4 shows that a preferred embodiment 61 of the present invention is comprised of a reservoir 65, a cover plate 67, wick assemblies, of which a typical one 69*a,* is shown. The reservoir 65 provides a space 73 for holding a quantity of UV-activated liquid adhesive. The apparatus can be constructed of any suitable material including wood or plastic using conventional fabrication techniques.

The top plate 67 has a smooth flat top surface 68 and is attachable to the top of the reservoir 65. Note that top plate 67 is provided with a number of slots, arrayed in a predetermined manner, and each one is designed to mount a wick assembly in a manner to be described. A pair of long slots 77 extends along opposite ends of the top plate, and two pairs of medium length slots 79 and 81, respectively, are spaced as shown. Finally there are transverse short slots 83 and 85.

Figure 5:
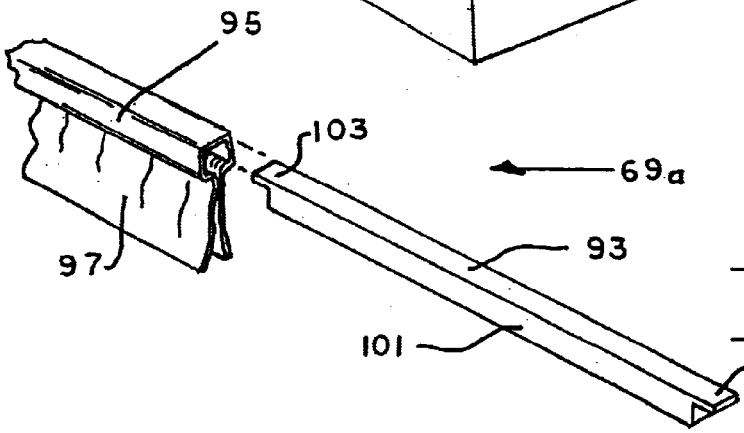
FIG. 5 is a partial, enlarged perspective view of a support bar and a felt wick used in the present invention.
Figure 7:
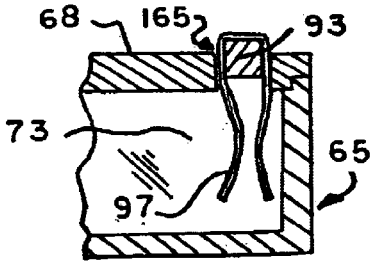
FIG. 7 is an enlarged sectional view taken along the line 7—7 of FIG. 6.

The third major component of the invention is the adhesive wick assembly, such as assembly 69*a* shown in FIG. 5, which is comprised of a support bar 93 and a sheet 95 of felt-like wick material that can be shaped so as to form a loop for receiving the bar 93 as indicated in FIG. 5, the wick having a downwardly extending lower portion 97. Although felt-like material is used here, it should be evident that there are other suitable liquid-absorbent materials can serve as a wick under the invention. Note that rod 93 has a slot-engaging portion 101 and opposite end parts 103 that will engage the top plate to vertically support the bar when it is mounted in slot 77. FIG. 7 illustrates how the felt covered bar 93 is received in slot 77 with the wick portion 97 disposed within the reservoir space 73, and providing an adhesive application surface 165.

Figure 6:
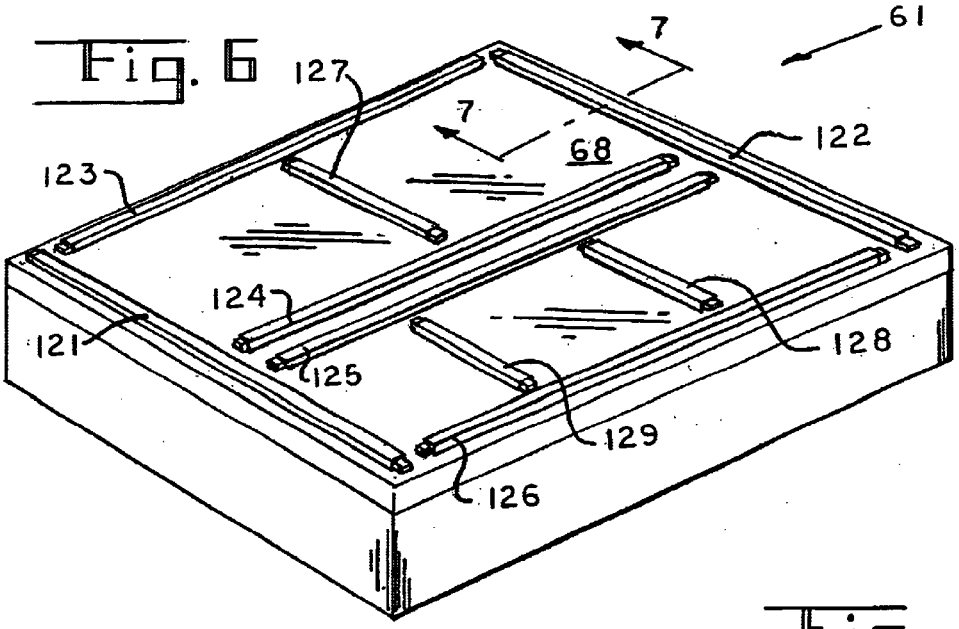
FIG. 6 is a view of the apparatus shown in FIG. 4, with a wick assembly installed in every slot.

The invention includes a number of other wick assemblies of similar construction to assembly 69*a,* and they are designed to be removably mounted in the remaining slots. Thus in FIG. 6, where all assemblies are installed, there are long assemblies 121 and 122, medium length assemblies 123, 124, 125 and 126, and short ones 127, 128 and 129.

It will now be discussed how the afore-described apparatus 61 can be used to apply adhesive to the selected sides of rectangular package components, such as those shown above in FIGS. 1, 2 and 3.

Figure 8:
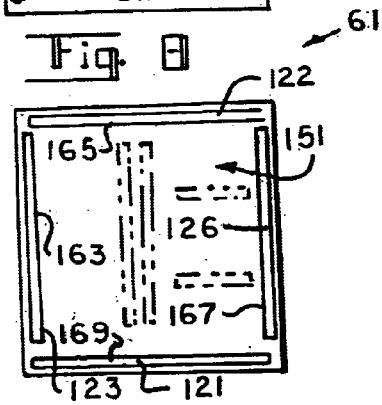
FIG. 8 is a top plan view of one configuration of wick assemblies, according to the present invention.

It can be appreciated that the afore-described wick assemblies can be selectively installed on the top plate to form rectangular spaces that can receive a package component for adhesive application. For example, in FIG. 8 (where empty slots are not shown, for the sake of clarity), it is illustrates how assemblies 121, 122, 123 and 126 can be installed to provide a space 151 for receiving a four-sided lid such as the lid 45 shown in FIG. 3.

The smooth top surface 68 of cover plate 67 will slidaby support lid 45, and the space 151 is wider and longer than the lid 45 so that it can be manipulated within the space, in a manner to be described. When reservoir 65 is supplied with liquid adhesive the lower portions of the wicks will immerse therein and wicking action will provide adhesive-wetted surfaces at 163 165, 167 and 169. An operator can now place lid 45 within the space 151 and move it through a generally circular path that causes the four sides of the piece to make engagement in succession with the four wetted surfaces. This results in the speedy application of a thin, even coat of adhesive to four sides of lid 45.

Figure 9:
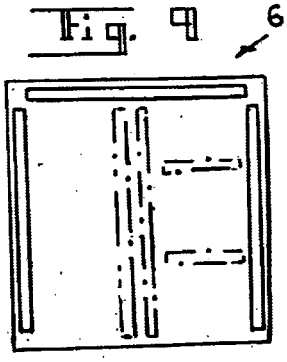
FIG. 9 is another configuration of wick assemblies.

FIG. 9 shows an arrangement of three wick assemblies for adhesive application to the three edges of the lid of a clamshell type package, such as the sides 31 of the package 21 of FIG. 2.

Figure 10:
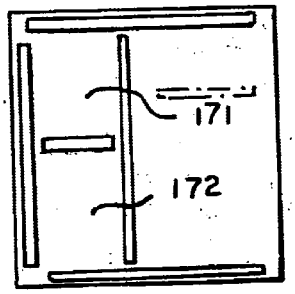
FIG. 10 is yet another configuration of wick assemblies.

The arrangement illustrated in FIG. 10 provides smaller spaces 171 and 172, which are suited for wetting four sides of relatively smaller pieces such as end caps 13 and 15 shown in FIG. 1. This arrangement lends itself to two operators stationed on opposite sides of the apparatus.

Figure 11:
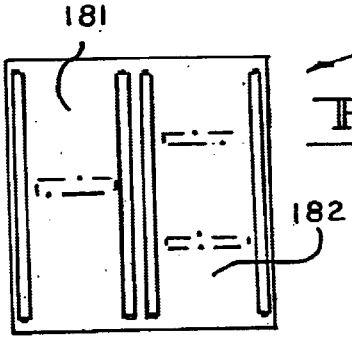
FIG. 11 are a further configuration of same.

In some instances only two opposing sides of a piece need adhesive, and the arrangement of FIG. 11 are best suited, and two operators on opposite sides of apparatus 61 can use spaces 181 and 182 for that purpose.

The foregoing are but a few of the wick assembly arrangements possible with the present invention, and it should be evident that there can be several other arrangements to handle a variety of types and sizes of package pieces, as desired.

While a particular embodiment of the invention has been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

What is claimed is:

1. Apparatus for applying adhesive to outer edges of a generally rectangular package component, said apparatus including:

a) a reservoir for holding a quantity of liquid adhesive;

b) an upper plate attached to an upper portion of said reservoir and having a smooth planar top surface, a pair of opposing spaced apart longitudinal slots, and a pair of opposing transverse slots, said transverse and longitudinal slots forming a generally rectangular configuration;

c) adhesive wick assemblies adapted for removable installation in said slots, each said assembly having an elongate upper portion which projects a predetermined distance above said top surface when said assembly is installed in said slot, and a lower portion that extends downwardly into the confines of said reservoir.

2. Apparatus as defined in claim 1 wherein each said wick assembly includes a wick member and an elongate support means for engaging the upper portion of said wick member.

3. Apparatus as defined in claim 2 wherein said support means comprises a bar, and wherein said wick member is a sheet of felt-like material that is removably mounted to said bar.

4. Apparatus as defined in claim 2 wherein said wick member is adapted to loop over said bar.

5. Apparatus as defined in claim 1 wherein there is a first pair of opposing spaced apart transverse slots adjacent the perimeter of said plate and a first pair of opposing spaced apart longitudinal slots along said perimeter, a second pair of closely spaced longitudinal slots along a mid portion of said plate, said first and second pairs of slots defining a first and second major surface portion on said top surface, and at least one transverse slot respectively in each of said surface portions.

* * * * *